US006230805B1

(12) United States Patent
Vercaemer et al.

(10) Patent No.: US 6,230,805 B1
(45) Date of Patent: May 15, 2001

(54) METHODS OF HYDRAULIC FRACTURING

(75) Inventors: Claude J. Vercaemer, Neuilly/s/Seine (FR); Terry G. Greene, Mandeville, LA (US); Douglas J. Pferdehirt, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/240,745

(22) Filed: Jan. 29, 1999

(51) Int. Cl.[7] ..... E21B 43/17
(52) U.S. Cl. ..... 166/300; 308/250.1
(58) Field of Search ..... 166/242.2, 250.7, 166/250.1, 290, 177.5, 280, 300, 308

(56) References Cited

U.S. PATENT DOCUMENTS

| | | | | |
|---|---|---|---|---|
| 3,612,181 | * | 10/1971 | Brooks | 166/295 |
| 4,064,941 | * | 12/1977 | Smith | 166/300 |
| 4,442,895 | * | 4/1984 | Lagus et al. | 166/250.1 |
| 4,801,389 | * | 1/1989 | Brannon et al. | 507/211 |
| 5,018,578 | * | 5/1991 | El Rabaa et al. | 166/281 |
| 5,327,971 | * | 7/1994 | Garbutt et al. | 166/250.07 |
| 5,411,085 | * | 5/1995 | Moore et al. | 166/242.2 |
| 5,417,284 | * | 5/1995 | Jones | 166/280 |
| 5,439,055 | | 8/1995 | Card et al. | 166/280 |
| 5,460,226 | * | 10/1995 | Lawson et al. | 166/300 |
| 5,551,516 | | 9/1996 | Norman et al. | 166/308 |
| 5,658,861 | | 8/1997 | Nelson et al. | 507/200 |
| 5,681,796 | | 10/1997 | Nimerick | 507/209 |
| 5,950,731 | * | 9/1999 | Shuchart et al. | 166/300 |

* cited by examiner

*Primary Examiner*—David Bagnell
*Assistant Examiner*—Jennifer Dougherty
(74) *Attorney, Agent, or Firm*—John E. Vick; Maryam Bani-Jamali

(57) ABSTRACT

A method of hydraulic fracturing is provided in which at least two separate fracturing fluid components are pumped downhole, one of said components being pumped downhole within coiled tubing. The fracturing fluid components responsible for increasing or decreasing the viscosity of the fracturing fluid are provided downhole separately from the polymer which is to be crosslinked, facilitating a delay in the onset of viscosity increase until the fluid has traveled a substantial distance downhole. Downhole pressures may be determined by measuring the pressure in coiled tubing while the fluid within the coiled tubing is in a non-dynamic condition. In some instances, the fluid can be used to plug or seal the formation from producing undesirable fluids, such as water.

23 Claims, 2 Drawing Sheets

METHODS OF HYDRAULIC FRACTURING

BACKGROUND OF THE INVENTION

1. Field of the Invention

The invention relates to the field of providing fluids downhole into a subterranean formation which are mixed for the first time within the subterranean formation, and in particular, to methods of fracturing employing coiled tubing. Methods are provided for separately administering fracturing fluid components which are mixed for the first time at a point downhole, allowing for combination of said components at a later time and at a location which is adjacent to the subterranean formation to be fractured.

2. Description of the Prior Art

In the recovery of oil and gas from subterranean formations it is common practice to fracture the hydrocarbon-bearing formation, providing flow channels for oil and gas. These flow channels facilitate movement of the hydrocarbons to the wellbore so they may be produced from the well. Without fracturing, many wells would cease to be economically viable.

In such fracturing operations, a fracturing fluid is hydraulically injected down a wellbore penetrating the subterranean formation. The fluid is forced down the interior of the wellbore casing, through perforations, and into the formation strata by pressure. The formation strata or rock is forced to crack open, and a proppant carried by the fluid into the crack is then deposited by movement of the viscous fluid containing proppant into the crack in the rock. The resulting fracture, with proppant in place to hold open the crack, provides improved flow of the recoverable fluid, i.e., oil, gas, or water, into the wellbore.

Fracturing fluids customarily comprise a thickened or gelled aqueous solution which has suspended therein proppant particles that are substantially insoluble in the fluids of the formation. Proppant particles carried by the fracturing fluid remain in the fracture created, thus propping open the fracture when the fracturing pressure is released and the well is placed on production. Suitable proppant materials include sand, walnut shells, sintered bauxite, or similar materials. The propped fracture provides a larger flow channel to the well bore through which an increased quantity of hydrocarbons can flow, thereby increasing the production rate of a well.

Hydraulic fracturing fluids usually contain a hydratable polymer which is crosslinked (and therefore thickened) on the surface of the ground by mixing it with crosslinking agent. The crosslinking agent thickens the fracturing fluid prior to and during the pumping of the fluid downhole. The polymer typically is hydrated upon the surface of the ground in a batch mix operation for several hours in a chemical mixing tank, and then mixed with a crosslinking agent over a period of time to greatly thicken the fluid and increase its viscosity so that is can carry the proppant into the fracture. The fluid is transformed by crosslinking from a water-like consistency into a thick fluid having a viscous jello-like consistency.

One difficulty with such processes is that a large number of additives are required to function at high temperatures, elevated pressures, and after undergoing significant frictional shear forces. These additives include, for example: bactericides, antifoam agents, surfactants to aid dispersion, pH control agents, chemical breakers, enzymatic breakers, iron control agents, fluid stabilizers, crosslinkers, crosslinking delay additives, antioxidants, salt(s) and the like. These additives must be formulated correctly (which is a difficult task), transported to location, mixed, pumped and metered accurately to execute the fracturing job properly. There are several disadvantages and costly problems associated with preparing and using polysaccharides which are pre-mixed with crosslinking agents on the surface of the ground and then passed downhole for later use as viscosifying proppant carrying compounds in the formation.

In fracturing, it would be ideal to achieve crosslinking of the fluid at a time just before the fluid reaches the perforation so that the fluid carries the proppant properly through the perforations and over the length of the fracture. If the crosslinking takes place after the fluid reaches the perforation, then a risk is presented that the proppant will not be carried across the perforations or that the fluid will not perform in the fracture. In either case, the fracturing event will not provide the anticipated results. On the other hand if crosslinking is taking place too early as the fluid makes its way down the wellbore, significant friction losses will be generated, increasing the pressure on surface and making execution of the job more difficult. Further, the fluid may be irreversibly degraded by the high level of shear in the wellbore, which in some extreme cases can jeopardize the entire job, such as in high temperature deep wells in which the fluid travels a long distance for a long time.

Achieving perfect timing for crosslinking is made even more difficult by the fact that every well has its own characteristics of depth, temperature and pump rate. Thus, any attempts to predetermine fluid crosslink timing at the surface requires a different formulation for every well. This sort of customization of fracturing methods is expensive and unmanageable. The problem is compounded when the conditions of treatment are extreme in terms of well depth and temperature. In some cases it can become the limiting factor in the execution of the job. Another limitation and difficulty with the conventional mode of fracturing is the delay between the time when the operator decides to change the viscosity of the fluid and the time when the change actually is implemented downhole. The change in fluid properties can be obtained by changing the composition on surface. But when such surface adjustment is employed, it then takes several minutes for the fluid with the modified composition to travel downhole to the point at which the change is required. A screen-out, in which proppant falls out of solution, blocking fluid flow and raising pressure to extremely high levels, can occur in a matter of seconds if conditions are not correct. This time delay in achieving fluid change reduces significantly the flexibility of the fracturing operation in terms of reacting to unforeseen events.

Fluids described above in the prior art, and used in the industry, are designed with compositions having predetermined properties that are averaged in an attempt to apply the fluids successfully to a wide variety of wellbore temperatures, pressures, and other characteristics. The more a particular wellbore deviates from the average, the less successful the particular composition or procedure will be in fracturing the well with maximum efficiency.

It has been known in the art to provide gaseous substances through a coiled tubing, thereby generating a foamed fracturing fluid downhole, for certain applications. These gaseous substances include, for example, nitrogen or carbon dioxide. Unfortunately, however, the limitations and problems previously described above often apply equally as well to such foamed fracturing fluids. In such instances, the crosslinking still occurs early, prior to or concurrently with the pumping of the fluid downhole, and polysaccharides usually have been mixed with crosslinkers and other substances above the ground, and then pumped downhole together as a mixture.

What is needed in the industry is a method of fracturing a wellbore in which the timing and degree of crosslinking is optimized and the adverse effects of shear degradation of the fluid are minimized. A method of fracturing using a fluid that is not made highly viscous prior to or immediately upon beginning its travel down the wellbore is desirable. Such a method of fracturing could reduce the friction pressures which must be applied to the fluid to transfer it downhole, thereby improving the fluid performance and reducing equipment horsepower requirements.

A desirable process of fracturing is shown where the viscosity of the fluid is not predetermined upon the above-ground mixing of polymer, crosslinker, activator, and breakers; but instead, viscosity of the fluid is adjustable after the initiation of fracturing and/or pumping. A method of customizing in real time the rheology characteristics of the fracturing fluid as the fluid is being applied to the subterranean formation to meet particular wellbore or reservoir characteristics is highly desirable.

SUMMARY OF THE INVENTION

A method of fracturing a subterranean formation below the ground surface is shown. Coiled tubing is inserted into a wellbore, and a first solution comprising a galactomannan gum and proppant is pumped into the annular space of the wellbore. The invention also comprises providing a second aqueous solution, the second aqueous solution comprising at least a crosslinking agent (and maybe other chemicals or additives) capable of crosslinking the galactomannan gum. Further, a coiled tubing string having interior and exterior surfaces is provided, the coiled tubing string forming on part of its exterior surface an annular space within the wellbore, said coiled tubing string having a proximal end located near the ground surface and a distal end located within the wellbore in the subterranean formation and close to the formation to be treated. The method further involves pumping into the annular space of the wellbore the first aqueous solution and pumping into the coiled tubing string the second aqueous solution. At the distal end of the coiled tubing string, the first and second aqueous solutions are combined, which is followed by crosslinking of the galactomannan gum to form a crosslinked fracturing fluid.

In some methods, the pumping of the crosslinker will be interrupted briefly for a length of time sufficient to make very accurate measurements of the downhole pressure in the coiled tubing string. In one embodiment, the method may be implemented with a cable inserted in the coiled tubing and connected to a pressure sensor located downhole. In such cases, the downhole pressure is continuously and precisely determined. When there is no cable, the downhole pressure can be estimated or calculated from the surface pressure measurement in the coiled tubing corrected for the friction losses when the crosslinker fluid is pumped and optionally measured more accurately by stopping the flow in the coiled tubing altogether. It is, of course, also possible to determine pressure in the dynamic state while fluid is flowing.

In some embodiments, the method may provide for a second fluid which is a crosslinking agent, further including the step of adjusting the amount of crosslinking agent provided to the fracturing fluid, thereby changing the viscosity of the fracturing fluid in the subterranean formation.

Other embodiments and methods of various types are possible, as would be readily observed by those of skill in the art of hydraulic fracturing and coiled tubing deployment.

DESCRIPTION OF THE PREFERRED EMBODIMENTS

The invention may employed in wellbores of many types, including those extending vertically or horizontally or somewhere between vertical and horizontal. The method is used to provide several advantages including but not limited to minimizing friction losses, increasing chemical efficiency, providing better fracturing job control, reducing or minimizing shear degradation, and transmitting pressure measurements to the surface.

Figure 1:
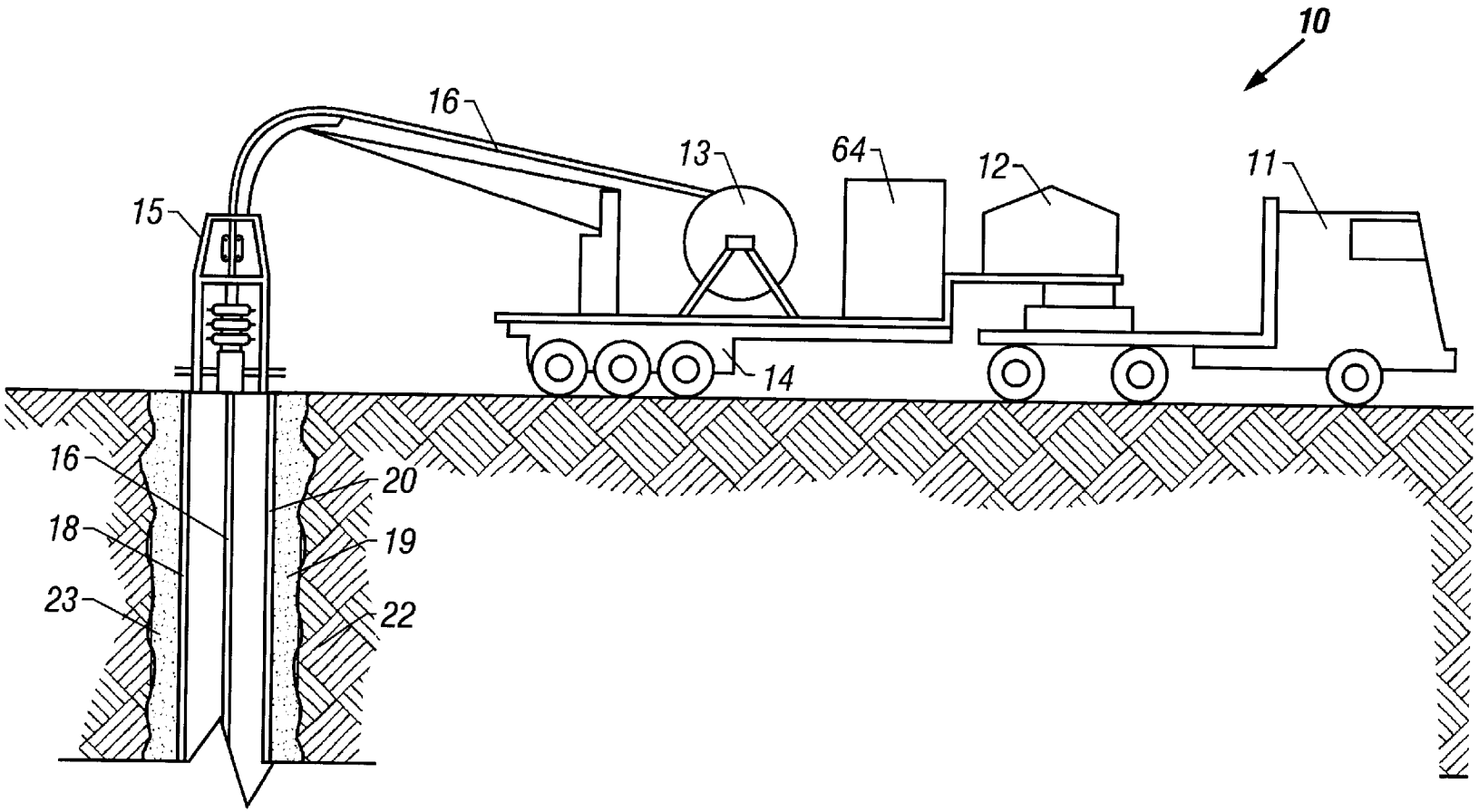
FIG. 1 shows a coiled tubing unit with coiled tubing deployed into a wellbore, the coiled tubing being capable of providing one component of a fracturing fluid downhole.

In FIG. 1, a coiled tubing equipment set-up 10 is shown. Truck cab 11 is connected to trailer 14 upon which liquid mix tank 12 and liquid containment vessel 64 are supported. Coiled tubing reel 13 provides coiled tubing 16 through injector 15 and into the wellbore underground. Coiled tubing 16 is disposed underground within production casing 18 and 20. Further, cement layers 19 and 23 form the boundary between the wellbore and the formation 22. Standard fracturing equipment including pumps, proppant, and fluids, such as known to those of skill in the art, also are assembled at the site (not shown).

Figure 2:
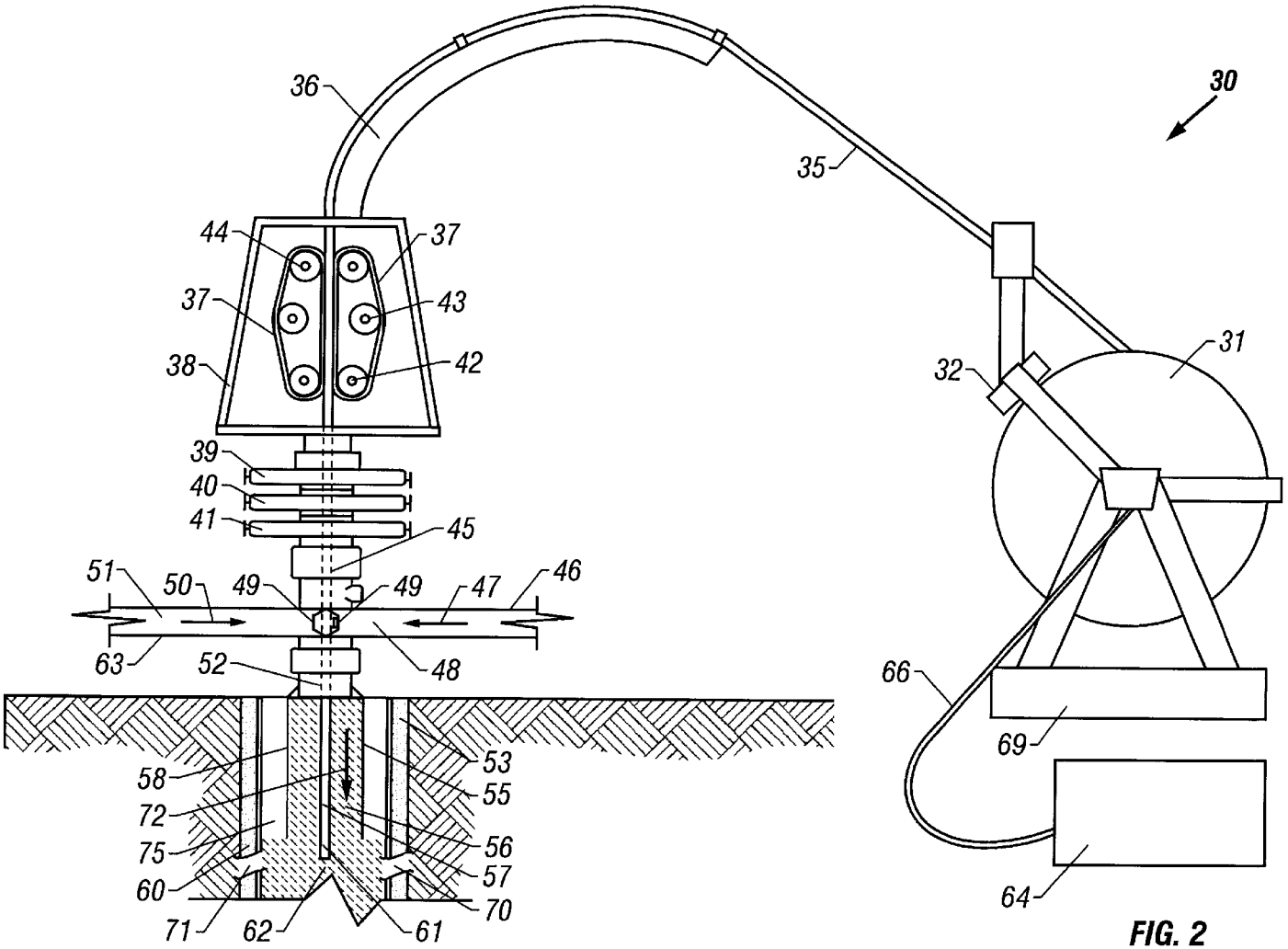
FIG. 2 details two separate fluid pathways which meet at a point downhole, thereby allowing fluid form each pathway to mix at a point near the distal end of the coiled tubing near the underground formation.

In FIG. 2, one may observe the details of how the fluids, including proppant, are provided downhole. Two fluid pathways are shown. The first pathway provides fluid down the interior of the wellbore, and outside the coiled tubing. The second pathway provides a second separate fluid down the interior of the coiled tubing, and these two separate fluid streams meet downhole, near the formation to be fractured, where crosslinking occurs.

Fracturing set-up 30 is shown in FIG. 2. Coiled tubing reel 31 is supported by reel support 69. Fluid is provided from fluid containment vessel 64 through fluid flow line 66 to the reel and into the interior of the coiled tubing 35. Coiled tubing is provided from the reel across levelwind 32 which maintains the tubing correctly positioned on the reel 31. The coiled tubing 35 proceeds over gooseneck 36 and into the injector assembly. Support frame 38 supports the injector assembly, which includes a pair of chain drives 37 which are powered by lower chain drive sprocket 42, middle chain drive sprocket 43, and upper chain drive sprocket 44. Below the injector assembly are rams 39, 40 and 41. Wellhead 45 proceeds into a flanged treating line. First treating line 46 and second treating line 63 meet with wellhead 45, and at that meeting point is provided blast joint 49 which is seen on either side of coiled tubing 36. At this juncture, the rapid fluid shear force would irreversibly damage the coiled tubing were it not for the blast joint which serves to protect the coiled tubing from the extremely abrasive effects of the proppant laden fluid proceeding at high rates past the joint. Further, the interior of the treating line 48 and 51 provide the fluid pathway for the proppant laden fluid past the blast joint and into the wellbore downhole. These fluid pathways are denoted by fluid flow paths 47 and 50 respectively.

Wellpipe 52 provides mechanical and fluid communication to the wellbore downhole. Cement layers 53 and 60 surround the wellbore 75. Within the wellbore and hanging from a point near the ground surface is the production tubing 55 and 58. On the interior of the production tubing is the coiled tubing 57, which forms on its exterior surface an annular space for fluid flow along fluid flowpath 72. The distal end of the coiled tubing 61 releases fluid to facilitate the combination of fluid from flow path 56 at fluid crosslinking point 62. The fluid crosslinking point is only slightly above perforations 70 and 71. In some cases, a downhole mixing device could be deployed to mix the fracturing fluids downhole. In some embodiments, the fluid can be used to plug or seal the formation from producing undesirable fluids, such as water.

There are many combinations of fluid components that may be provided along each of the two fluid flow pathways shown in the Figures. In a preferred embodiment, the fluid proceeding along the wellbore (i.e. outside the coiled tubing) is comprised of at least a polysaccharide and a proppant. Preferably, the fluid traveling along inside the tubing is comprised of at least the crosslinking species. Many combinations are possible in that the various fluids to be provided in different fracturing operations include but are not limited to gels, surfactants, clay control additives, bactericides, fluid loss control agents, scale control agents, activators, breakers, and others. A person of skill in the art readily could propose one or more fracturing fluid formulations which could be used advantageously in this invention to fracture the formation efficiently with superior fluid characteristics.

In some cases, liquid breaker could be provided in the coiled tubing towards the end of a job. Alternatively, a breaker aid, liquid resin, or other component could be provided as part of the fluid. A preferred embodiment would be to provide the polysaccharide and proppant in one fluid stream and the crosslinker in a second fluid steam. Optionally and additionally, one may provide surfactants, clay control agents, bactericides, fluid loss control agents, activators, or breakers in either fluid stream, depending upon the particular rheology characteristics desired.

The polysaccharide may be selected from guar, hydroxypropyl guar, carboxymethylhydroxypropyl guar, hydroxyethylcellulose, and polyacrylamides, among others. The crosslinker may be selected from among known types of crosslinking systems for fracturing fluids, including borates, zirconates, titanates, etc., such as that disclosed in U.S. Pat. Nos. 5,681,796; 5,658,861; 5,551,516; and 5,439,055; each of which hereby are incorporated by reference as if set forth fully in this specification.

The flow rate of the fluid in the coiled tubing may be adjusted in real time during the fracturing job. In that way, the amount of crosslinker, for example, which is afforded downhole is likewise adjusted real time, allowing for real time control of the viscosity of the fluid. So if a well happens to experience large amounts of fluid loss, higher than expected temperatures or pressures, excessive brines, or any other set of circumstances that might alter the rheology of the fluid downhole, adjustments can be made in real time. Further, the amount of activator can likewise be metered or adjusted to affect downhole fluid characteristics.

It is possible to stop flow in the coiled tubing and measure or calibrate downhole bottom hole pressure. Such measurements are quite useful to help in minimizing the pressure drop in the tubing and facilitates the correct rheology just above the perforations. However, it is not always required that flow be reduced or stopped to obtain pressure measurements, and dynamic pressure measurements may be accomplished in some instances. Sometimes, pressure measurements may be used to correlate for adjustments in the components of the fluids in real time so that fracturing fluid rheology is controlled during actual fracturing of the well.

This technique allows the operator to react very quickly to special responses from the formation. For example, changing the pump rate of the crosslinker down the tubing allows for a change in the crosslinker concentration near the perforations in a matter of seconds instead of in much longer time spans when, as in the prior art, the fluid is crosslinked and provided in one unit downhole. In some cases, this real time adjustment makes the difference between a successful fracturing job and an unsuccessful job (sometimes called a screen-out).

In some cases, the techniques of this invention facilitate much higher viscosity or efficiency in the formation, allowing the fracturing event to achieve sufficient fracture characteristics with minimum horsepower and equipment requirements on the surface. In many cases, higher temperature and deep wellbores may be advantageously fractured using this invention because it provides the temperature history and shear history of the fluid after crosslinking is improved. This results because crosslinking does not occur using this invention until a time and location well down beneath the ground, and near the formation to be fractured. This results in a fluid which is less depleted when it reaches the formation in terms of its physical properties such as shear history, chemical interactions, temperature history, etc. Wellbores with bottom hole temperatures in excess of 250 degrees F. are particularly suitable for the application of this invention.

The invention has been described in the more limited aspects of preferred embodiments hereof, including numerous examples. Other embodiments have been suggested and still others may occur to those skilled in the art upon a reading and understanding of this specification. It is intended that all such embodiments be included within the scope of this invention.

What is claimed is:

1. A method of providing a fracturing fluid to a subterranean formation penetrated by a wellbore, comprising:

(a) providing a first aqueous solution, the first aqueous solution comprising
a polysaccharide, and
one or more of the following: surfactant, clay control agent, bactericide, fluid loss control agent;

(b) providing a second aqueous solution, the second aqueous solution comprising one of the following: crosslinking agent, activator, and breaker;

(c) providing a coiled tubing string having interior and exterior surfaces, the coiled tubing string having a portion of its length within the wellbore beneath the ground surface, the coiled tubing string forming on part of its exterior surface an annular space with the wellbore, said coiled tubing string having a proximal end located near the ground surface and a distal end located within the subterranean formation;

(d) pumping into the annular space of the wellbore the first aqueous solution, (e) pumping into the proximal end of the coiled tubing string the second aqueous solution, (f) combining the first aqueous solution with the second aqueous solution at a location near the distal end of the coiled tubing string; and (g) crosslinking the polysaccharide to form a fracturing fluid.

2. The method of claim 1 additionally comprising the step of:

(h) fracturing the subterranean formation.

3. The method of claim 2 additionally comprising the step of:

(i) breaking the fracturing fluid.

4. A process of fracturing a subterranean formation penetrated by a wellbore, comprising:

(a) providing a first aqueous solution, the first aqueous solution comprising a polysaccharide and a proppant, the polysaccharide selected from guar, hydroxypropyl guar, carboxymethylhydroxypropyl guar, hydroxyethylcellulose, and polyacrylamide;

(b) providing a second aqueous solution, the second aqueous solution comprising a crosslinking agent and a breaker;

(c) providing a coiled tubing string having interior and exterior surfaces, said coiled tubing string having a proximal end located near the ground surface and a distal end located within the subterranean formation;

(d) pumping into wellbore the first aqueous solution, (e) pumping into the proximal end of the coiled tubing string the second aqueous solution, (f) combining the first aqueous solution with the second aqueous solution;

(g) crosslinking the polysaccharide to form a fracturing fluid;

(h) fracturing the subterranean formation; and (i) breaking the fracturing fluid.

5. The process of claim 4 wherein the amount of one or more of the components of the second aqueous solution which are made available to the subterranean formation may be adjusted during the fracturing step.

6. A method of fracturing a subterranean formation penetrated by a wellbore comprising the step of pumping a first aqueous fluid down the wellbore and a second fluid down a coiled tubing string disposed in the wellbore, said fluids being pumped at a pressure and flow rate sufficient to fracture the subterranean formation, wherein a fracturing fluid is formed downhole by combining downhole the first aqueous fluid and second fluid, wherein the fracturing fluid further comprises proppant.

7. The method of claim 6 further wherein the fracturing fluid characteristics may be altered during the fracturing event by adjusting the composition or flow rate of the second fluid.

8. The method of claim 7 further wherein the second fluid comprises crosslinkers, further wherein the viscosity of the fracturing fluid formed downhole is capable of real time adjustment by increasing or decreasing the concentration of crosslinker in the second fluid which is applied downhole.

9. The method of claim 7 further wherein the second fluid comprises a breaker, further wherein the viscosity of the fracturing fluid formed downhole is capable of real time adjustment by increasing or decreasing the concentration of breaker in the second fluid which is applied downhole.

10. The method of claim 7 further wherein the second fluid comprises an activator, further wherein the viscosity of the fracturing fluid formed downhole is capable of real time adjustment by increasing or decreasing the concentration of activator in the second fluid which is applied downhole.

11. A method of controlling during fracturing the increase or decrease in viscosity of a fracturing fluid downhole during a hydraulic fracturing operation, comprising:

(a) providing tubing downhole within a wellbore, (b) pumping a first fluid downhole through the wellbore, (c) metering a second fluid downhole through the tubing, (d) combining the first and second fluids downhole to form a fracturing fluid, (e) wherein metering of the second fluid in step (c) is capable of controlling the increase or decrease in viscosity of the fracturing fluid.

12. The method of claim 11 further comprising the step of obtaining a bottom hole pressure measurement during fracturing.

13. A method of fracturing a subterranean formation below the ground surface, comprising:

(a) providing a first aqueous solution, the first aqueous solution comprising a galactomannan gum and proppant;

(b) providing a second aqueous solution, the second aqueous solution comprising a crosslinking agent capable of crosslinking the galactomannan gum;

(c) providing a coiled tubing string having interior and exterior surfaces, the coiled tubing string having a portion of its length within a wellbore beneath the ground surface and a portion of its length above the ground surface, the coiled tubing string forming on part of its exterior surface an annular space within the wellbore, said coiled tubing string having a proximal end located near the ground surface and a distal end located within the wellbore in the subterranean formation;

(d) pumping into the annular space of the wellbore the first aqueous solution;

(e) pumping into the coiled tubing string the second aqueous solution;

(f) combining the first and second aqueous solutions;

(g) crosslinking the galactomannan gum to form a fracturing fluid; and (h) providing the fracturing fluid to perforations in fluid communication with the subterranean formation.

14. The method of claim 13 further comprising maintaining the fluid within the coiled tubing string in a non-dynamic condition for a length of time sufficient to measure the pressure in the coiled tubing string.

15. The method of claim 13 further wherein the bottom hole temperature in the subterranean formation is in excess of 250 degrees F.

16. A method comprising:

(a) providing tubing downhole within a wellbore, (b) pumping a first fluid downhole through the wellbore, (c) metering a second fluid downhole through the tubing, (d) combining the first and second fluids downhole to form a fracturing fluid, (e) measuring the pressure within the tubing, and (f) determining the downhole pressure.

17. The method of claim 16 further wherein the second fluid comprises a crosslinking agent, further including the step of step of:

(g) adjusting the amount of crosslinking agent provided to the fracturing fluid, thereby changing the viscosity of the fracturing fluid in the subterranean formation.

18. A method of conducting oilfield service operations, comprising:

(a) mobilizing a coiled tubing unit at the site of a wellbore, (b) providing coiled tubing downhole beneath the ground and within said underground wellbore, (c) mobilizing fracturing equipment at said site, (d) pumping a first fluid downhole beneath the ground, (e) pumping a second fluid downhole beneath the ground and through the tubing, and (f) combining the first and second fluids, for the first time, at a point located beneath the surface of the ground to form a crosslinked fracturing fluid.

19. The method of claim 18 wherein the second fluid comprises at least one fluid selected from the group of fluids comprising crosslinking agents, stabilizers, and breakers, and further including the step of adjusting the amount of said second fluid provided to the fracturing fluid, thereby controlling in real time the viscosity of the fracturing fluid in the subterranean formation.

20. A method of providing fluid to a subterranean formation penetrated by a wellbore, comprising:

(a) providing a first solution, (b) providing a second solution, (c) providing a coiled tubing string having interior and exterior surfaces, the coiled tubing string having a portion of its length within a wellbore beneath the ground surface, the coiled tubing string forming on part of its exterior surface an annular space within the wellbore, said coiled tubing string having a proximal end located near the ground surface and a distal end located within the subterranean formation;

(d) pumping into the annular space of the wellbore the first solution, (e) pumping into the proximal end of the coiled tubing string the second solution, (f) combining the first solution with the second solution to form a fluid at a location near the distal end of the coiled tubing string wherein the fluid is employed to fracture the formation.

21. A method comprising:

(a) providing tubing downhole within a wellbore, (b) pumping a first fluid downhole through the wellbore, (c) metering a second fluid downhole through the tubing, (d) combining the first and second fluids downhole to form a fracturing fluid, and (e) measuring the pressure downhole.

22. The method of claim 21 further including the following step:

(f) adjusting fluid properties of the first fluid or second fluid to optimize fracturing in response to the degree of pressure measured in step (e).

23. A method of providing a fracturing fluid to a subterranean formation penetrated by a wellbore, comprising:

(a) providing a first aqueous solution, the first aqueous solution comprising a polysaccharide, (b) providing a second aqueous solution, the second aqueous solution comprising a crosslinking agent, (c) providing a coiled tubing string having interior and exterior surfaces, the coiled tubing string having a portion of its length within the wellbore beneath the ground surface, the coiled tubing string forming on part of its exterior surface an annular space with the wellbore, said coiled tubing string having a proximal end located near the ground surface and a distal end located within the subterranean formation;

(d) pumping into the annular space of the wellbore the second aqueous solution, (e) pumping into the proximal end of the coiled tubing string the first aqueous solution, (f) combining the first aqueous solution with the second aqueous solution at a location near the distal end of the coiled tubing string; and (g) crosslinking the polysaccharide to form a fracturing fluid.

* * * * *